US008961257B2

(12) United States Patent
Connor

(10) Patent No.: US 8,961,257 B2
(45) Date of Patent: Feb. 24, 2015

(54) FLEXIBLE LAMINATED CONSTRUCTION TOY SET AND METHOD OF MANUFACTURE THEREOF

(71) Applicant: Kiva Connor, Chicago, IL (US)

(72) Inventor: Kiva Connor, Chicago, IL (US)

(73) Assignee: Fibre-Craft Materials Corp., Niles, IL (US)

( * ) Notice: Subject to any disclaimer, the term of this patent is extended or adjusted under 35 U.S.C. 154(b) by 108 days.

(21) Appl. No.: 13/787,030

(22) Filed: Mar. 6, 2013

(65) Prior Publication Data

US 2014/0256208 A1 Sep. 11, 2014

(51) Int. Cl.
*A63H 33/08* (2006.01)
*A63H 33/04* (2006.01)

(52) U.S. Cl.
CPC ..... *A63H 33/04* (2013.01)
USPC ..... 446/107

(58) Field of Classification Search
CPC ..... A63H 33/04; A63H 33/06; A63H 33/065; A63H 33/102
USPC ..... 446/85, 107, 108, 109, 114, 115, 124; 434/82
See application file for complete search history.

(56) References Cited

U.S. PATENT DOCUMENTS

| | | | | |
|---|---|---|---|---|
| 3,236,007 | A * | 2/1966 | Abeson | 446/374 |
| 3,830,011 | A * | 8/1974 | Ochrymowich | 446/126 |
| 4,387,530 | A * | 6/1983 | Miller | 446/387 |
| 4,426,821 | A * | 1/1984 | Moore et al. | 52/646 |
| 4,666,417 | A | 5/1987 | Hillman | |
| 5,498,190 | A | 3/1996 | Ganson | |
| 5,769,994 | A | 6/1998 | Booz et al. | |
| 5,875,792 | A * | 3/1999 | Campbell et al. | 132/246 |
| 5,916,006 | A | 6/1999 | Ganson | |
| 7,479,054 | B2 * | 1/2009 | Wittenberg et al. | 446/373 |

* cited by examiner

*Primary Examiner* — Kurt Fernstrom
(74) *Attorney, Agent, or Firm* — Vedder Price P.C.

(57) ABSTRACT

The present disclosure relates generally to flexible laminated construction toy set and method of manufacture thereof, and more particularly to a construction set made of pieces with a bendable metal layer enclosed by two layers of a plastic mat. Two flexible think plastic mats with potentially a surface printed design are sealed around an internally deformable metal insert. Sets are sold using multiple geometry elements each having a different purpose, a different design to enhance playability.

12 Claims, 5 Drawing Sheets

FLEXIBLE LAMINATED CONSTRUCTION TOY SET AND METHOD OF MANUFACTURE THEREOF

FIELD OF THE DISCLOSURE

The present disclosure relates generally to a flexible laminated construction toy set and method of manufacture thereof, and more particularly to a construction set made of pieces with a bendable metal layer enclosed by two layers of a plastic mat.

BACKGROUND

Children require activities to pass time. Toys are used to stimulate the imagination and creativity of children while at the same time serving the purpose of helping a young mind evolve into a coherent, intelligent, and well-formed adult. One field of toys that can be purchased or gifted is construction sets. Construction sets are made from a plurality of pieces that can be assembled in a number of ways to generate different results.

Generally sold in a series of boxes, either in small quantity, large quantity, or even extension sets, a child will collect as many pieces as possible to help create larger and more elaborate creations. Each set as sold differs and the rarity and usefulness of each piece can differ. Amongst the most popular construction kits available on the market are rigid building blocks like those sold by the LEGO® Corporation. Other kits available center around a doll that can be dressed, housed, like the goods sold by the American Girl® Corporation. In the United States, there are multiple types of construction sets each designed with a specific purpose and a different playability.

One type of known construction sets is sold under the BENDAROOS® brand. This technology is protected under U.S. Pat. No. 5,916,006 ("Ganson") and is shown as prior art at FIG. 10. These sets are made of connecting pieces made of rigid foam and tubes also made of foam with a wire metal insert that is capped at both end and once bent will remain in the deformed shape. Since this technology relies on foam having a density between 1.5 and 6 pounds per cubic foot, the foam bodies of these pieces is rather large. Because of the thickness of the foam, each piece can only be bent to a certain limit.

What is needed is a new method of manufacture and of production that relies on the soft and bendable technology of the BENDAROOS® but where each piece has greater flexibility, more malleability, incorporates greater design and aesthetic elements, to create smaller scale models and creations that mimic everyday goods and also can be worn as jewelry.

SUMMARY

The present disclosure relates generally to flexible laminated construction toy set and method of manufacture thereof, and more particularly to a construction set made of pieces with a bendable metal layer enclosed by two layers of a plastic mat. Two flexible thick plastic mats with potentially a surface printed design are sealed around an internally deformable metal insert. Sets are sold using multiple geometry elements each having a different purpose, a different design to enhance playability.

BRIEF DESCRIPTION OF THE DRAWINGS

The following disclosure as a whole may be best understood by reference to the provided detailed description when read in conjunction with the accompanying drawings, drawing description, summary, abstract, background of the disclosure, field of the disclosure, and associated headings. Identical reference numerals when found on different figures identify the same elements or functionally equivalent elements. The elements listed in the summary and abstract are not referenced but nevertheless refer by association to the elements of the detailed description and associated disclosure.

DETAILED DESCRIPTION

Figure 1:
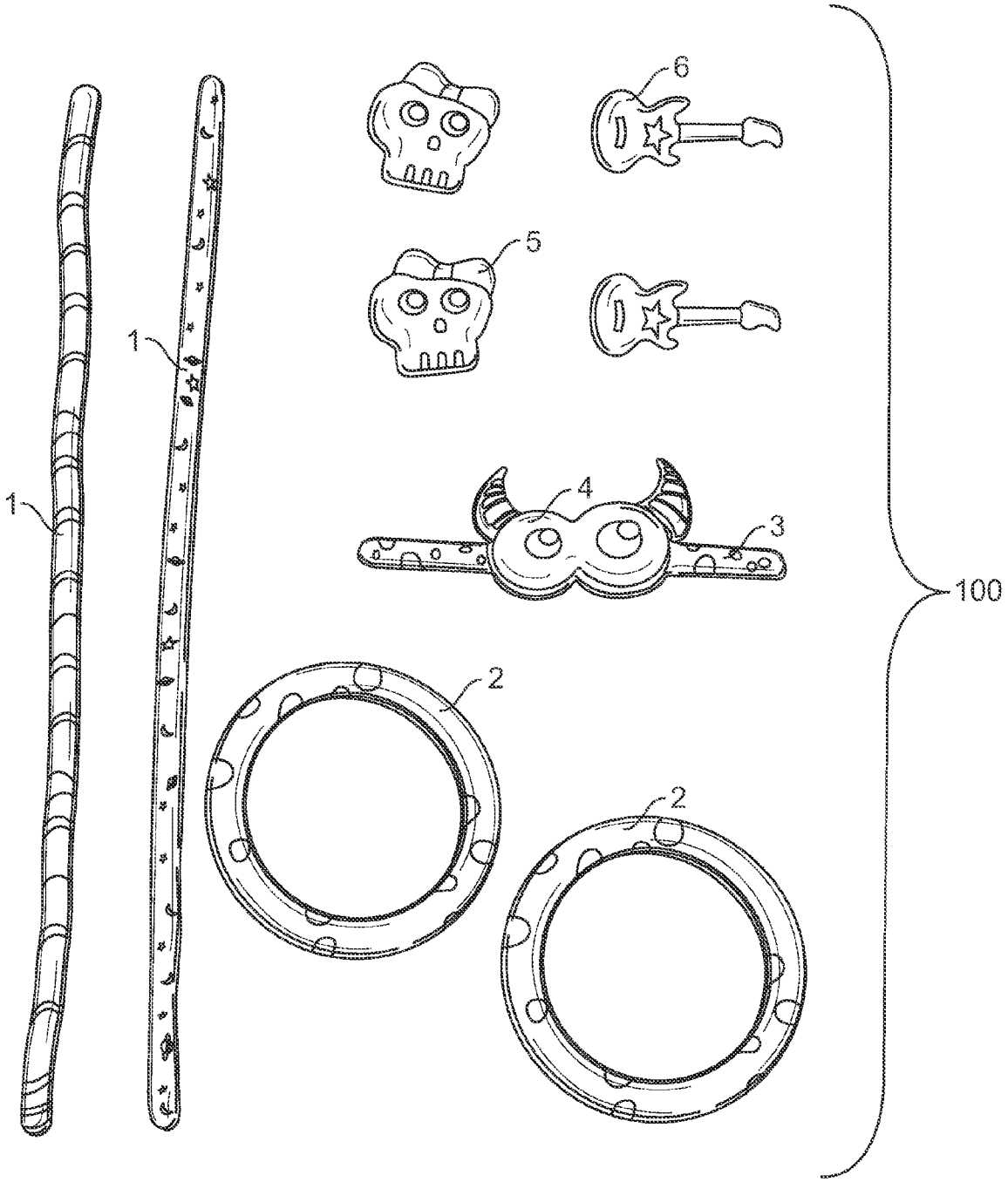
FIG. 1 is reproduction of series of bendable elements, connector elements, and aesthetic elements, as part of a construction set to create designs according to an embodiment of the present disclosure.

For the purposes of promoting and understanding the invention and principles disclosed herein, reference is now made to the preferred embodiments illustrated in the drawings, and specific language is used to describe the same. It is nevertheless understood that no limitation of the scope of the disclosure is thereby intended. Such alterations and further modifications in the illustrated devices and such further applications of the principles disclosed as illustrated herein are contemplated as would normally occur to one skilled in the art to which this disclosure relates.

When forces or strain are place upon metal, it either deforms elastically or plastically. Elastic deformation is a change in size that is not permanent and once the force or strain is removed, the metal returns to the pre-strained configuration. Plastic deformation is a property of metal to change form permanently under stain while not breaking. Generally, plastic deformation occurs once the acceptable strain elastic deformation limit is passed for a given metal. For example, a paperclip elastically deforms when slid to hold a couple of pages, but when the number of pages increases, the paper clip will locally deform plastically. When a metal is plastically deformed, it is 'bent' into a different shape. Aside from fatigue cracks or micro-tears, metal is perfectly suited for successive plastic deformation.

To the contrary, most polymer or plastics while having both elastic and plastic deformation regions associated with different levels of strain, the polymer or plastic is damaged when plastic deformations occur. For example, reticulations will break creating a change in color. Much like reinforced concrete relies on metal when placed in fraction and the concrete when placed in compression to give the whole a greater resistance to any strain, the principle behind for creation of the different bendable elements, connector elements, or aesthetic elements of the kits disclosed is to create kits made of elements that can be bent into a different shape and that can hold this new shape until a new shape is desired. Unlike prior art construction sets where thick foam is used, this new technology relies on plastic mats of a density greater than 6 pounds per cubic foot, and in one preferred embodiment, a mat having a density in the range of 10 to 15 pcf, and more specifically 13±1 pcf. Each mat is 1-4 mm thick, with a preferred thickness of approximately 2.5±1 mm. The mats may be made of multi-ply pieces with double side lamination and Polyvinyl Chloride covers, or a small soft interior with laminated top layers.

What is shown at FIG. 1 is a flexible construction toy set 100 shown with a large number of elements numbered 1 to 6. What is contemplated by the inventor is the sale of different size boxes, packages, pouches, each containing any number of elements designed to create a number of different structures formed from a plurality of elements. These sets 100 include instructions in the form of illustrations, pictures, written or digital media for quick access to inspiration.

Figure 2:
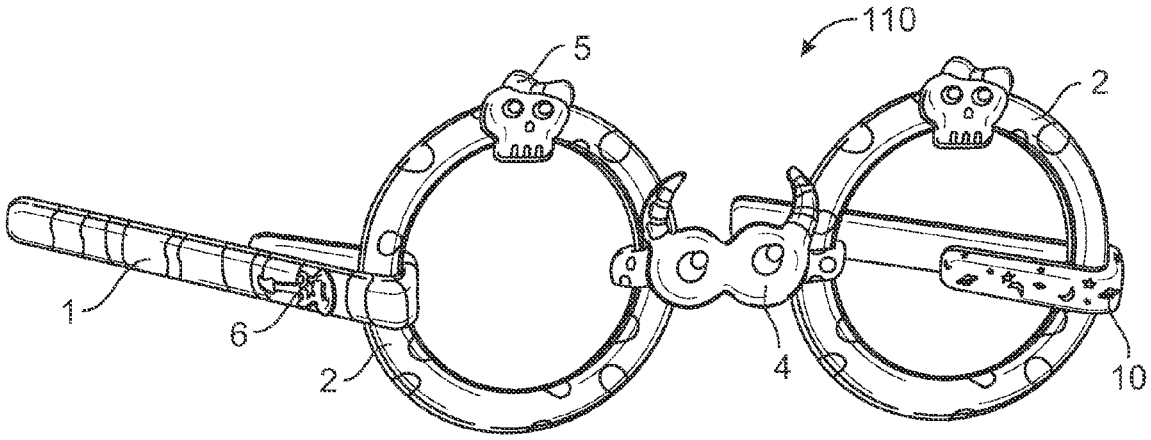
FIG. 2 is a design created from the bendable elements, connector elements, and aesthetic elements shown at FIG. 1 to create a pair of glasses to be worn by the designer according to one embodiment of the present disclosure.

One possible set is shown at FIG. 1 and is then shown in its assembled form at FIG. 2. All of the elements shown at FIG. 1 can be assembled to form a pair of glasses to be worn by a child. Boxes forming the sets 100 can have a theme, a design element based on any number of different known and created element. For example, a famous morning cartoon can be licensed to help create a theme for the different elements and pieces of the set 100. The external shape of each of these elements can be cut to different shapes and to match the different design elements printed on them. For example, element 5 is a little skull head in the associated shape with the associated design embossed.

As shown, some of the smaller elements that do not have a shape where a portion can be bent (as element 4 on FIG. 2) to attach to other elements, either an adhesive can be placed on the back side of the elements with a pealed paper so a child can simply stick the element on the others to help assemble the overall shape (as element 5 on FIG. 2). In another embodiment, the metal insert inside each piece can be made of a metal that can be magnetized and instead of placing an adhesive paper or even some other type of connecting means. What is contemplated is the use of any attachment technology known in conjunction with bendable elements to make a set 100 with the greatest playability.

Going back to the design at FIG. 1, the set 100 includes two long sticks 1, two rounded shapes 2, a middle connector 4 illustrated as a little horned character with a central design element 4, and several little decorative elements 5, 6 attached to the glasses. To assemble the pair of glasses 110, the ends 3 of the middle connector 4 are bent around the two different circles 2. The end portion of the two long sticks 1 are also bent at opposite ends of the circles 2. Finally, the small design elements 5, 6, are placed.

Within the scope of this disclosure, we will refer to the elements as bendable elements (i.e. elements with a metal insert that can be bent into shape and will retain the bent shape) for example elements 1, and 4, connector elements or elements that can be used to connect and join other elements (with or without a metal insert) like elements 2, and 4, and aesthetic elements that serve the purpose of enhancing the structures created by the other elements of the set such as the bendable elements and/or the connector elements like elements 5, and 6.

Figure 10:
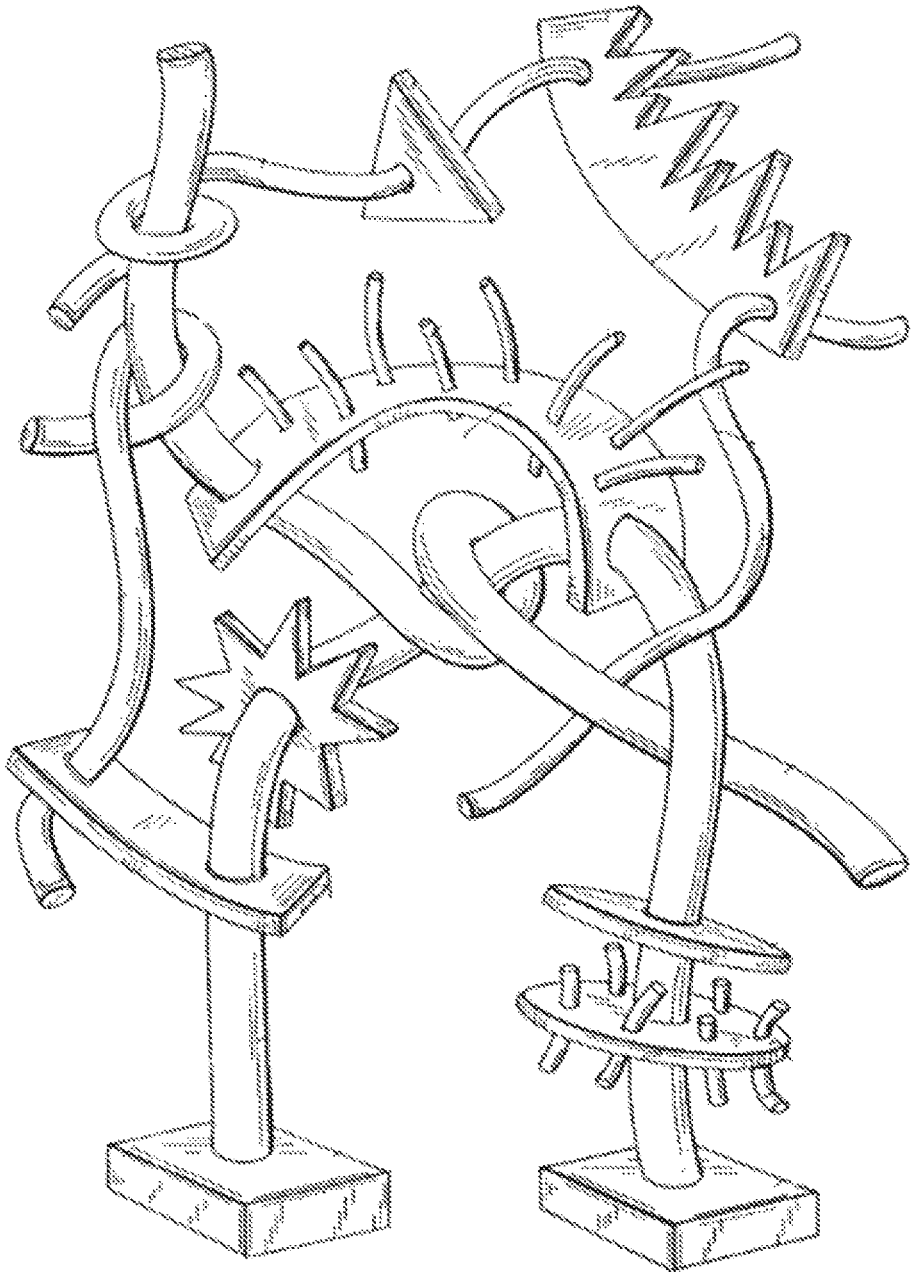
FIG. 10 (PRIOR ART)
FIG. 10 is an illustration from the Prior Art from U.S. Pat. No. 5,916,006 ("Ganson").

As part of the design of each construction set 100, designers will help create a wide variety of different elements (bendable, connectors, or aesthetic) that can be easily adapted to create a wide variety of overall constructions. For example, a set could be designed to create airplanes, or a branded franchise. In such a case, the construction set 100 will include all of the design elements in such a way to help recreate a needed world or atmosphere that reinforces the desired design. As illustrated at FIG. 2, because of the limited thickness of the plastic mats used in the elements, unlike the inventions from the prior art made of foam, the bend of each element can be up to 180 degrees and can wrap and hold around another adjacent element. The foam structures of the prior art as shown at FIG. 10 were unable to bend more than approximately 45 degree and required external foam elements and connector pieces to help define a full structure.

Figure 3:
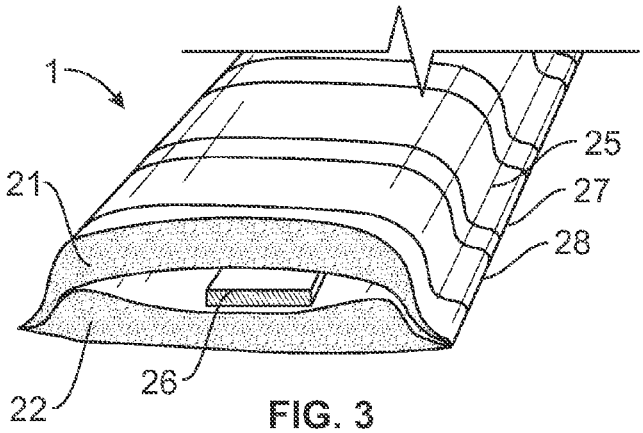
FIG. 3 is a 3D cross sectional view of a bendable element of the construction kit shown at FIG. 1 according to an embodiment of the present disclosure.
Figure 4:
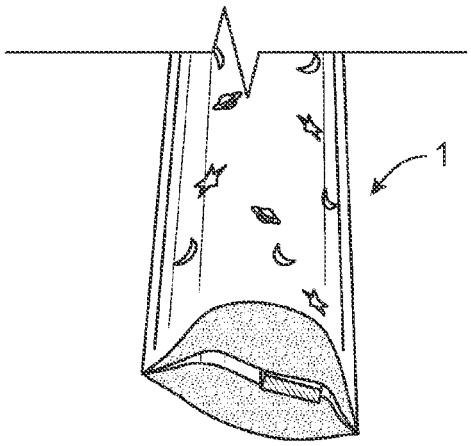
FIG. 4 is also a 3D cross sectional view of one of the bendable elements of the construction kit shown at FIG. 1 according to an embodiment of the present disclosure.
Figure 7:
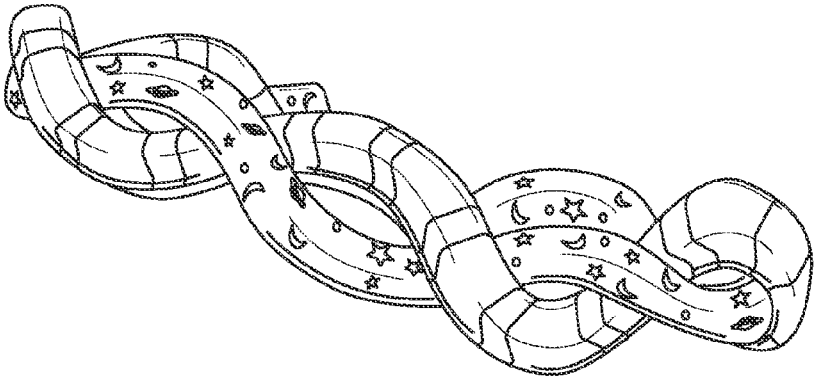
FIG. 7 is a 3D illustration of the two bendable elements of FIG. 6 when twisted with each other according to another embodiment of the present disclosure.

What is shown is a set 100 comprising a first plurality of elements 1, 2, 4, 5, and 6 where elements have different shapes like sticks, circles, etc. where at least some of the elements are capable of retaining a bent shape due to a metal insert encased fully between two plasticized surfaces. FIGS. 3, and 4 show a cross section of the stick element 1 from FIG. 1. The bendable element 1 is made of a flat piece of metal 26 between two plasticized mats 21, 22 joined by sealing such as pinching, stamping, or any other known closing method at the outer periphery 27. Since the metal insert 26 is flat and the overall shape of the stick element 1 is also flat, there is no issue of improper movement of the metal insert 26 into the plasticized sleeve created around the metal. The sticks 1 can be bent and twisted into any different shape as shown at FIG. 7.

The thickness of the metal insert 26 is calculated in a way to allow the element to be easily bent but having such a strength to prevent the return elastic force of the two layers of plastic mats 21, 22 to deform the element back into shape. One of ordinary skill in the art will understand that the width of the metal insert 26 is also relevant in the overall physical properties of the insert and also allows for lateral twisting and lateral deformations to occur to further increase the usefulness and playability of the stick 1 alone or as part of a set 100.

Figure 5:
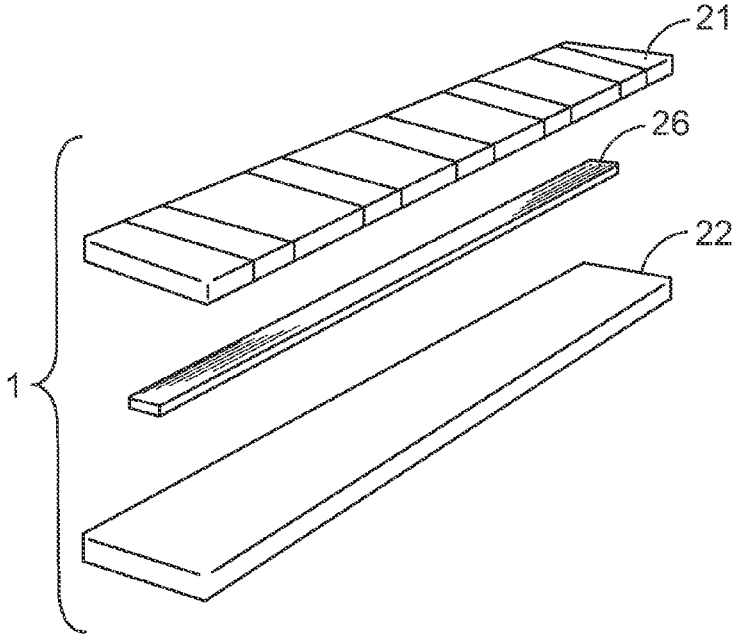
FIG. 5 is an isometric illustration of two layers of plastic mats sandwiched around a metal insert to form a bendable element as shown at FIG. 1 according to an embodiment of the present invention.
Figure 6:
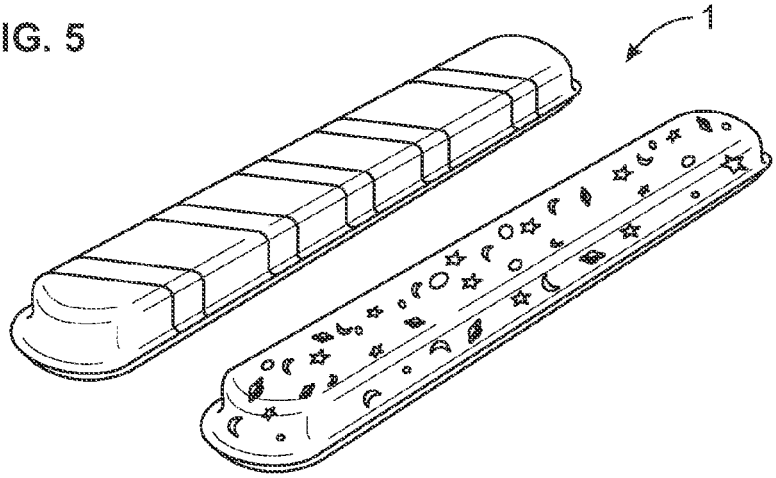
FIG. 6 are two isometric views of the bendable elements shown at FIG. 1 and formed as shown at FIG. 5 and described in the methods of FIGS. 8-9 according to an embodiment of the present disclosure.
Figure 8:
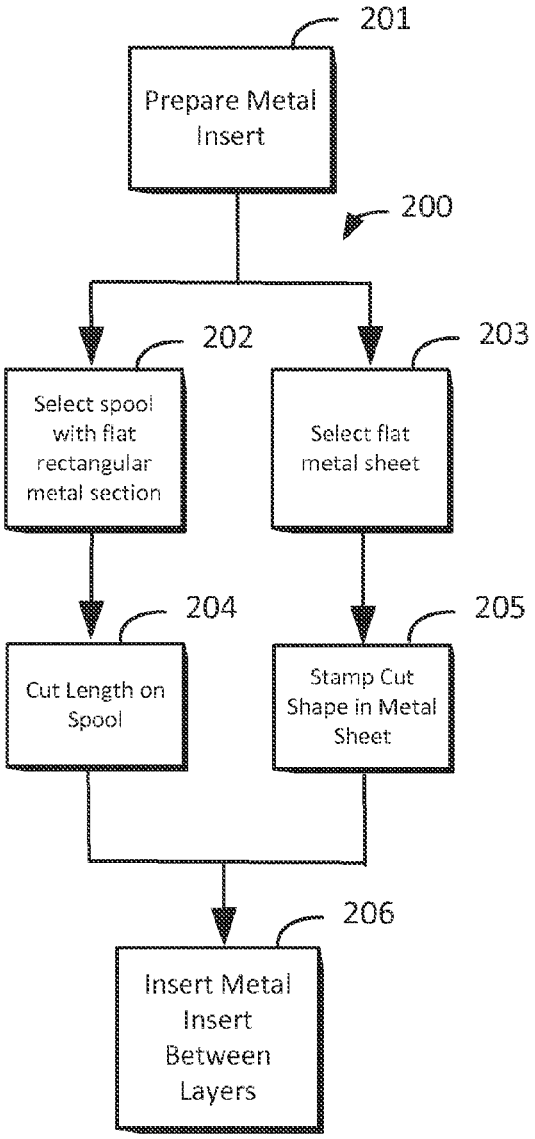
FIG. 8 is a diagrammatical representation of the different steps associated with the preparation of the metal insert for use within any elements of the construction kit as shown at FIG. 1.
Figure 9:
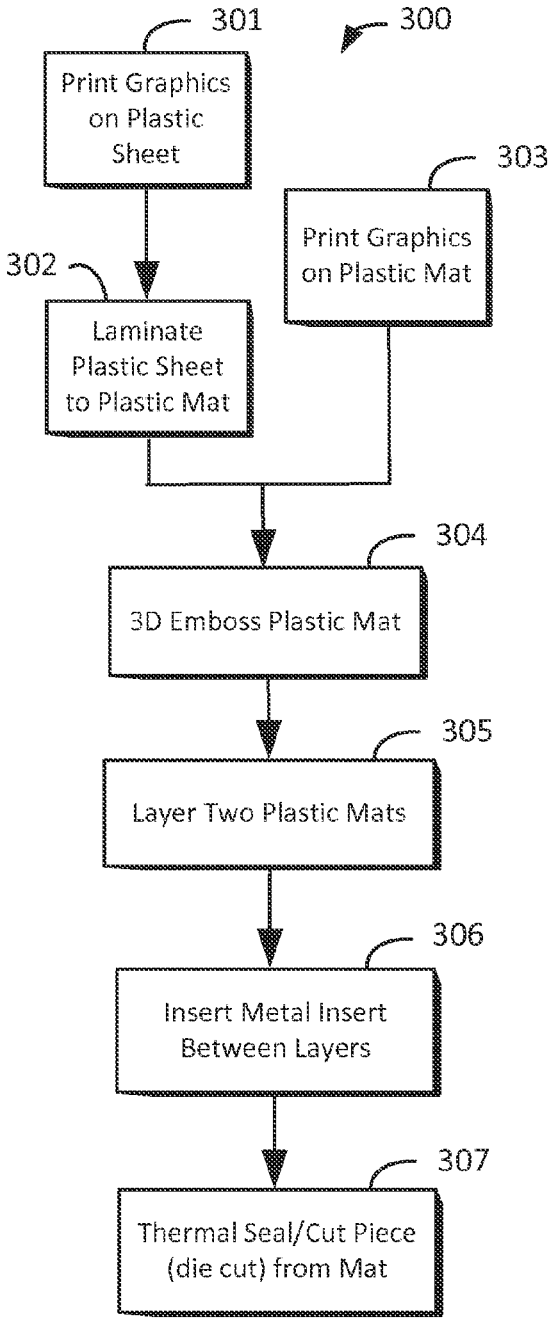
FIG. 9 is diagrammatical representation of the different steps associated with the production of a bendable element as shown at FIG. 5 according to an embodiment of the present disclosure.

Each of the bent shape retaining elements as shown are manufactured using a process with the steps are described in greater detail at FIGS. 8 and 9. FIG. 5 shows the three segments forming a stick 1 before they are assembled and FIG. 6 shows the same three segments forming the stick 1 once they are assembled according to the process or method as described in full at FIGS. 8, and 9. While one process or method of manufacture 300 is described, one of ordinary skill will understand that other related methods and processes can be used.

First, a party will select a first plasticized surface 21 as shown at FIG. 5. What is shown is a square piece but one of ordinary skill in the art will understand that as part of several different types of industrial processes, the size of the sheet 21 can be part of a roll, pre-cut, or of any size. The first plasticized surface 21 can be a plastic mat 303 on which graphics can be printed 303 or not or can be a laminated compound where graphics are printed on a plastic or other type of sheet 301 before it is attached to a plastic mat 302.

Printing can be made on one of the two plasticized surfaces 21, 22. The print can be of any design needed. What is also contemplated is a blank unprinted surfaces 21, 22. A blank unprinted surface could be used in conjunction with markers to force children to design and color their own pieces to help further increase the playability of the set 100. In addition to using a printed design, what is contemplated is the use as part of the process of the step of creating a three dimension embossing of the plastic mat or the plastic sheet to create a three dimensional effect. Other known methods can be used to further enhance each pieces, for example the attachment on the two plasticized surfaces 21, 22 of other decorative items.

The method 300 next includes the step of placing the first plasticized surface 21 over a metal insert 26 formed from a flat metal sheet stamp cut in shape. This is shown at FIG. 5. While one method is described to obtain the flat metal sheet, what is contemplated is any method or process that results in the use of metal sheeting 26. After both mats are layered 305, a second plasticized surface 22 below the metal insert to fully enclose the metal insert 26 between the first plasticized surface 21 and the second plasticized surface 22. In a subsequent step, a thermal seal 307 is made at a first external edge 27 of the first plasticized surface 21 to a second external edge 28 of the second plasticized surface to fully encase the metal insert 26.

Finally, using any one of multiple technologies, the piece is cut from the two plasticized surfaces 21, 22 at the first and second external edges 27, 28 to separate a finished flexible construction element (for example 1) from the first and second plasticized surfaces 21, 22. In one embodiment, the metal insert 26 is made from a spool (not shown) with a flat rectangular metal section cut into length instead of a flat metal sheet stamp cut in shape. In one embodiment, the cutting of the mat is made using a die cut.

Persons of ordinary skill in the art appreciate that although the teachings of the disclosure have been illustrated in connection with certain embodiments, there is no intent to limit the invention to such embodiments. On the contrary, the intention of this application is to cover all modifications and embodiments falling fairly within the scope of the teachings of the disclosure.

What is claimed is:

1. A flexible construction toy set, comprising:

a first plurality of elements having a different shape where at least some of the elements are capable of retaining a bent shape due to a metal insert encased fully between two plasticized surfaces, wherein each of the bent shape retaining elements is manufactured using a process with the steps of: selecting a first plasticized surface, printing on the first plasticized surface graphics, placing the first plasticized surface over the metal insert formed from a flat metal sheet stamp cut in shape, placing a second plasticized surface below the metal insert to fully enclose the metal insert between the first plasticized surface and the second plasticized surface, thermal sealing a first external edge of the first plasticized surface to a second external edge of the second plasticized surface to fully encase the metal insert, and cutting the first and second plasticized surfaces at the first and second external edges to separate a finished flexible construction element from the first and second plasticized surfaces, wherein some of the first plurality of elements are used as connectors to attach other of the first plurality of elements; and at least a second plurality of elements unable to retain a bent shape and without any metal insert.

2. The flexible construction toy set of claim 1, wherein the first and second plasticized surfaces are selected from a group comprising a plastic sheet or a plastic mat.

3. The flexible construction toy set of claim 2, wherein the process further includes the step of creating a three dimension embossing of the plastic mat or the plastic sheet to create a three dimensional effect.

4. A flexible construction toy set, comprising:

a first plurality of elements having a different shape where at least some of the elements are capable of retaining a bent shape due to a metal insert encased fully between two plasticized surfaces, wherein each of the bent shape retaining elements is manufactured using a process with the steps of: selecting a first plasticized surface, printing on the first plasticized surface graphics, placing the first plasticized surface over a metal insert, placing a second plasticized surface below the metal insert to fully enclose the metal insert between the first plasticized surface and the second plasticized surface, thermal sealing a first external edge of the first plasticized surface to a second external edge of the second plasticized surface to fully encase the metal insert, and cutting the first and second plasticized surfaces at the first and second external edges to separate a finished flexible construction element from the first and second plasticized surfaces, wherein some of the first plurality of elements are used as connectors to attach other of the first plurality of elements; and at least a second plurality of elements unable to retain a bent shape and without any metal insert;

wherein the metal insert is made from a spool with a flat rectangular metal section cut to length.

5. The flexible construction toy set of claim 1, wherein the cutting of the two plasticized surfaces is made using a die cut.

6. The flexible construction toy set of claim 1, wherein the two plasticized surfaces are approximately 2 mm thick polyvinyl chloride sheets.

7. The flexible construction toy set of claim 6, wherein the plasticized surfaces are further made of a plastic sheet laminated to a plastic mat.

8. A process for the manufacture of an elements for use in a flexible construction set, the process including the steps in any order of:

selecting a first plasticized surface and printing on the first plasticized surface graphics;

placing the first plasticized surface over a metal insert formed from a flat metal sheet stamp cut in shape;

placing a second plasticized surface below the metal insert to fully enclose the metal insert between the first plasticized surface and the second plasticized surface;

thermal sealing a first external edge of the first plasticized surface to a second external edge of the second plasticized surface to fully encase the metal insert; and cutting the first and second plasticized surfaces at the first and second external edges to separate a finished flexible construction element from the first and second plasticized surfaces.

9. The process of claim 8, wherein the first and second plasticized surfaces are selected from a group comprising a plastic sheet or a plastic mat.

10. The process of claim 9, further including the step of creating a three dimension embossing of the plastic mat or the plastic sheet to create a three dimensional effect.

11. A process for the manufacture of an element for use in a flexible construction set, the process including the steps in any order of:

selecting a first plasticized surface and printing on the first plasticized surface graphics;

placing the first plasticized surface over a metal insert;

placing a second plasticized surface below the metal insert to fully enclose the metal insert between the first plasticized surface and the second plasticized surface;

thermal sealing a first external edge of the first plasticized surface to a second external edge of the second plasticized surface to fully encase the metal insert; and cutting the first and second plasticized surfaces at the first and second external edges to separate a finished flexible construction element from the first and second plasticized surfaces;

wherein the metal insert is made from a spool with a flat rectangular metal section cut to length.

12. The process of claim 11, wherein the cutting of the first and second plasticized surfaces is made using a die cut.

* * * * *